United States Patent [19]

Iglesias Hernandez

[11] 4,371,649

[45] Feb. 1, 1983

[54] PROCESS FOR BINDING AGGREGATES WITH A VACUUM-ACTIVATED CATALYST

[76] Inventor: Eduardo Iglesias Hernandez, Carretera Navarra Epele, 39, Hernani (Guipúzcoa), Spain

[21] Appl. No.: 283,943

[22] Filed: Jul. 16, 1981

[30] Foreign Application Priority Data

Jul. 22, 1980 [ES] Spain ..... 493.602

[51] Int. Cl.[3] ..... C08L 61/14; C08L 61/10

[52] U.S. Cl. ..... 523/145; 523/139; 523/142; 523/148; 523/340; 524/590; 524/594; 524/597; 524/601

[58] Field of Search ..... 260/37 N, 38, 39, 40, 260/998.18; 264/101, 102, DIG. 78; 164/21; 523/139, 140, 141, 142, 143, 144, 145, 146, 147, 148, 340; 524/594, 597, 590, 601

[56] References Cited

U.S. PATENT DOCUMENTS 3,428,110 2/1969 Walker et al. ..... 164/21

3,943,089 3/1976 Harpula et al. ..... 260/998.18

*Primary Examiner*—Lewis T. Jacobs

*Attorney, Agent, or Firm*—Wenderoth, Lind & Ponack

[57] ABSTRACT

Process of binding aggregates by mixing aggregates with resin binder and vacuum-activated catalyst, applying a partial vacuum to the mixture to activate the catalyst, and curing the binder.

5 Claims, 6 Drawing Figures

PROCESS FOR BINDING AGGREGATES WITH A VACUUM-ACTIVATED CATALYST

BACKGROUND OF THE INVENTION

The present invention relates to a process for binding aggregates with a vacuum-activated catalyst. The invention is generally related to the preparation of a binder suitable for use in foundry, which binder is obtained when a resin is reacted with a blocked catalyst, the unblocking of which is achieved under vacuum.

The invention is mainly applicable to the manufacture of cores and molds, following an absolutely original technique in this field which results in remarkable economic, hygienic and cleaning advantages when compared with the system normally used.

In fact, in the foundry industry, metals, molds and cores are cast by mixing an aggregate, generally silica, although zirconium, olivinic, and other oxides can also be used, with binders. Hardening of these binders takes place with the help of a suitable catalyst and by supplying the case or mold with heat which has been introduced therein by the normal methods of blowing, firing, pouring, etc.

However, in the case of other binders which harden by cooling, a gaseous catalyst should be supplied to produce polymerization of the binder, i.e. hardening thereof.

The main disadvantages of these processes, clearly the most commonly used, reside in that when the catalyst is activated by supplying heat, there is a high consumption of energy. In the other case, when the catalyst is injected in the form of gas, which gas can normally be more or less harmful, the atmosphere in the working zone becomes unpleasant, and even dangerous, if the necessary safety measures are not adopted.

SUMMARY OF THE INVENTION

In the process of the present invention, the supply of heat is reduced rather considerably and the disadvantages derived from the gaseous catalysts are simultaneously prevented.

The present invention is based on the displacement of a reaction by means of a vacuum and, consequently, the activation of the polymerization catalyst for a resin which constitutes the binder of the aggregate, in accordance with the following reaction:

$$A + B \rightleftarrows AB \qquad (1)$$

wherein A is the catalyst for a polymerization reaction and B is a compound which neutralises A, so that the prior equilibrium is displaced further to the right. The equilibrium concentrations, according to the value of the constant K, are determined by the following equation:

$$K = \frac{[AB]}{[A]\,[B]} \qquad (2)$$

If the pressure is suitably lowered to the operating temperature, B can be evaporated more rapidly the greater the vacuum in the system.

The reduction in the concentration of component B forces the reaction (1) to be displaced towards the left in order to preserve the value of K (constant) in the equation (2).

Thus, there will be an increase in the concentration of component A, which will catalyse the polymerization reaction, which operation is provoked in a controlled manner, according to the equation:

$$R + A = P_r$$

wherein R is the resin, A is the unblocked catalyst and $P_r$ is the polymer obtained.

Consequently, in view of the a foregoing, the basis of the present invention resides in the use of a blocked polymerization catalyst which, during the operating phase, is unblocked by the vacuum.

DETAILED DESCRIPTION OF THE INVENTION

Figure 1:
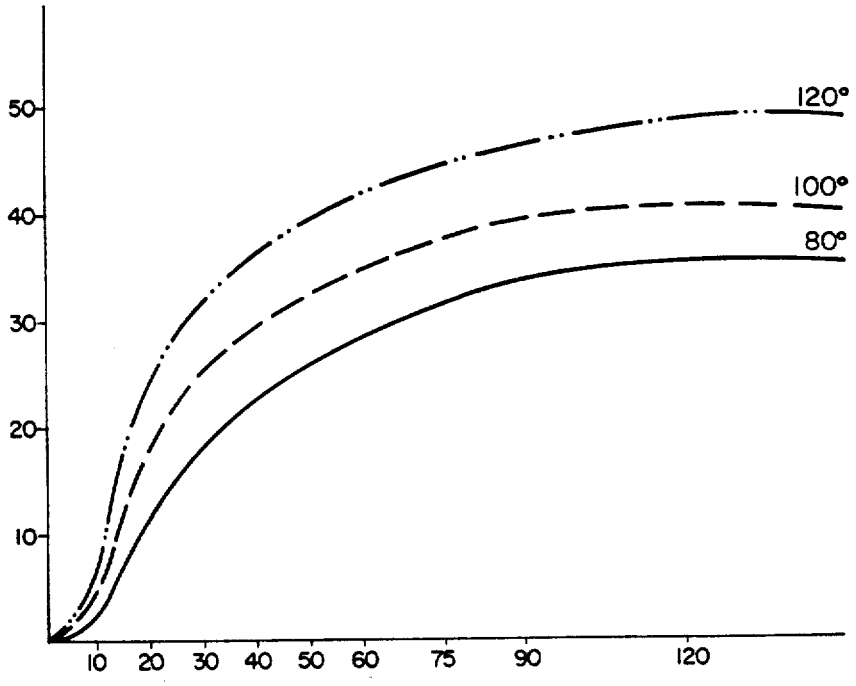
FIGS. 1–6 show the relationship between the resistance to heat flexure (FIGS. 1, 3 and 5) or cold flexure (FIGS. 2, 4 and 6) of a polymerization product of the present invention and the polymerization time at three polymerization temperatures.

The binding components are characterised by the suitability thereof to polymerise at temperatures of from 50° to 100° C., and in that they confer the following properties, among others:

(a) High mechanical resistance to tensile, flexural and compressive strength;

(b) suitability to bind aggregates, generally silica;

(c) resistance to moisture;

(d) suitable shelf life of the mixture with the aggregate and other additives.

In the present invention, the composition of the binding agent comprises pure resins or resins modified with other components, having an advanced degree of polymerisation. Preferably thermostable resins, such as pure phenolic resins and/or resins modified with urea and/or furfuric acid, melamine resins, polyester resins, polyurethane resins, can, among others, be catalysed.

Resins having a tested effectiveness in the present invention are the phenolic resins modified with furfuryl alcohol having a water content lower than 5%, i.e. those commonly known as anhydrous, preferably having a water content lower than 2%. The molar ratio between formol and phenol can be variable, from 0.6/1 to 3/1, preferably from 0.7/1 to 1.5/1.

The molar ratio between phenol and furfuryl alcohol can be from 1/0.5 to 1/10, preferably from 1/0.8 to 1/1.

The catalytic component of the resin is an organic acid, preferably an organic sulfonic acid, e.g. toluenesulfonic acid or phenolsulfonic acid, or an inorganic acid, e.g. sulfuric acid, suitably neutralised with a base which is volatile under the operating temperature and vacuum conditions, preferably a primary amine, e.g. alkylamines of 1–8 carbon atoms. A maximum residual pressure of 300 mm of mercury, preferably from 10 mm to 70 mm of mercury, is necessary.

The solvents used should have a low boiling point, and should require a relatively low vaporization heat. This improves the vaporization since a reduced pressure is used, therefore reducing the vapor pressure, and thus obtaining very short elimination times of the solvents.

The binding compounds used in the present invention are conveniently mixed with the aggregate, and frequently with other additives, such as iron oxide, carbon dust, bituminous products and others.

The aggregates which can be employed in the present invention are those normally used in the foundry industry, e.g. silica, and zirconium and olivinic oxides, preferably silica.

The proportion of the binding components can range from 0.5 to 5%, preferably lower than 2%. The proportion of the aggregate can consequently range from 99.5% to 95%, preferably 98%. The previously mentioned additives are normally used between 0.1 and 5%, preferably lower than 1%. The previously mentioned resinous binding components are obtained by reacting a phenol with an aldehyde. The phenols used in the formation of phenolic resins are all those non-substituted phenols normally employed in the formation of phenolic resins and others having two positions, substituted in para- and ortho-positions or two ortho positions, non-substituted, necessary for the polymerization reaction to take place.

The substituted phenols used in the formation of these resins can be phenols substituted by alkyl, aryl, sulfurated halogen groups, etc.

The most commonly used phenols are the non-substituted phenols, preferably cresols and xylenols.

The aldehyde commonly used is formaldehyde, which can be used in an aqueous solution or polycondensed solution, preferably in the form of paraformol.

The resins initially obtained can be of the novolak, resol or resitol type, as previously indicated, modified with furfuryl alcohol and having a water content lower than 5% (anhydrous resins), preferably lower than 2%. Normally, silanes are added to improve the surface tension of the binder in the aggregate.

The process for binding aggregates with a vacuum-activated catalyst offers, as mentioned at the beginning of this description, important advantages when compared with the commonly used techniques. Among such advantages is that the mixture of aggregate, blocked catalyst and, the binding resin necessary in the manufacturing process has a sufficiently long life. Another very important advantage is that the polymerization reaction is produced in a very short period of time by carrying out the vacuum within the mold or case, as a result of the activation of the catalyst.

Another advantage is the saving in energy when compared with thermal polymerization processes, while at the same time the atmosphere in the working zone is clearly improved. Thus, the normal deformation due to thermal shock can be prevented.

Likewise, an improvement is obtained when compared with normal cold polymerization processes, avoiding the necessity of using more or less harmful gases, as the catalysts.

As previously indicated, the operating temperature of the present invention depends on the values of the vapor pressures of component B which neutralizes the catalyst, and clearly on the time in which the polymerization is to be obtained, as will be seen from the examples which complete this description. In fact, the vacuum completely prevents vapors in the working zone, whereby a pleasant and sanitary atmoshpere is attained.

In the following examples parts and percentages are indicated by weight. The results of the examples are graphically illustrated in the accompanying drawings, wherein the axis of ordinates corresponds to the resistance of the polymerization product to heat flexure expressed in $Kg/cm^2$ in FIGS. 1, 3 and 5, while the axis of abscissas of these figures corresponds to the polymerization time in the mold seconds. The three curves obtained correspond to polymerization temperatures of 80° C., 100° C. and 120° C.

Figure 2:
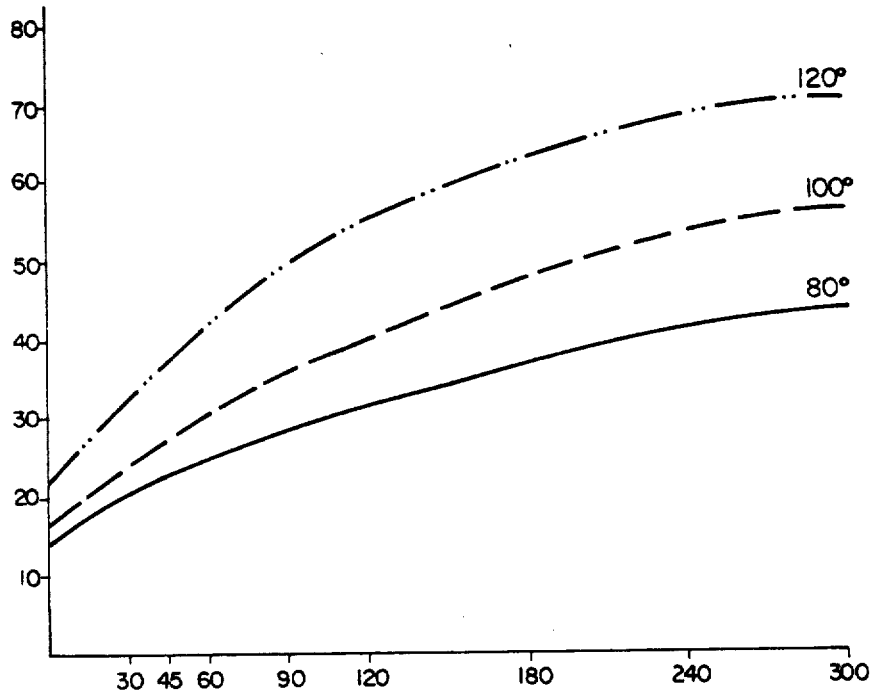
Figure 4:
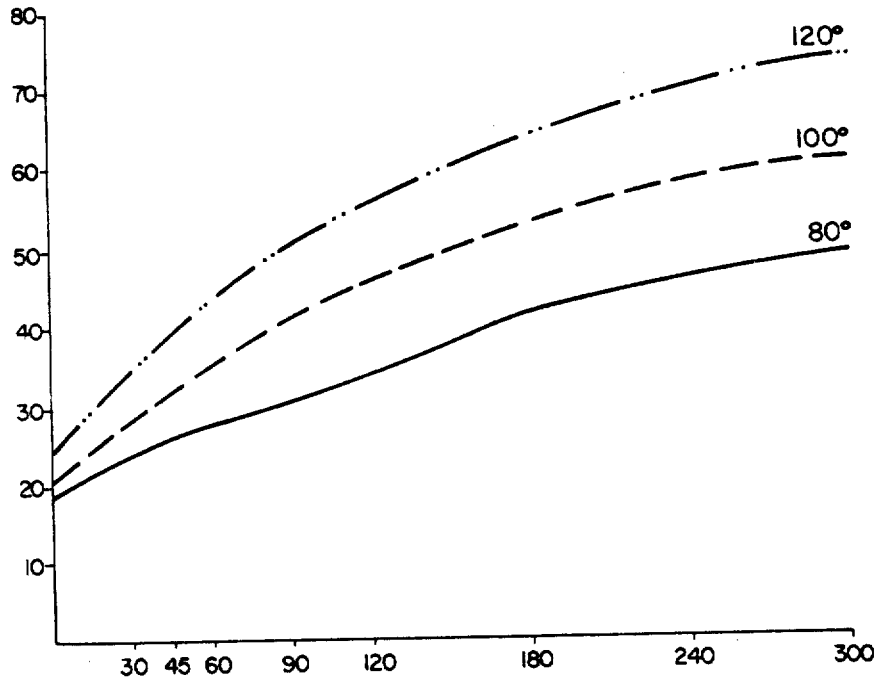
Figure 6:
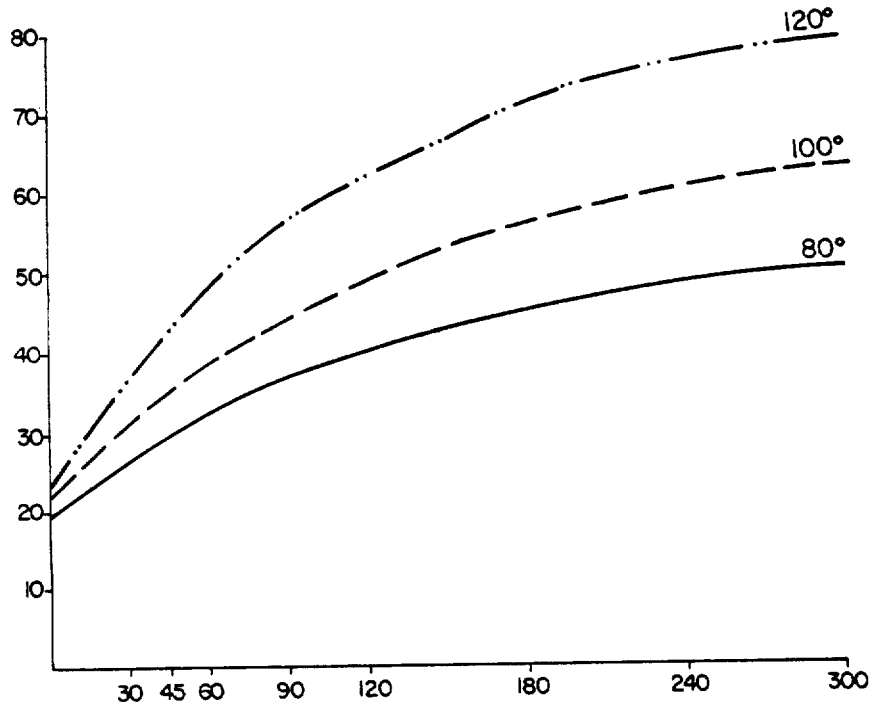

The ordinates of FIGS. 2, 4 and 6, correspond to the resistance to cold flexure and the abscissas correspond to the polymerization time.

EXAMPLE 1

400 gr. of siliceous sand with 55/60 AFA and a certain percentage of fines (<0.125 mm, sieve No. 8, series DIN 4188) lower than 3% were introduced in a mixer-beater which rotates at 150 r.p.m.

Then 35 gr. of a catalyst consisting of a sulfonated organic acid neutralised with an amine, and 70 gr. of a resin consisting of a resol from the polycondensation of phenol, formol and furfuryl alcohol, were added. The resin was previously prepared in an autoclave provided with a stirrer, reflux condenser and dehydration system, in which there are introduced 100 kgs. of a 100% concentrated phenol and 100 kgs. of a 37% solution, by weight, of formaldehyde in water. 1 Kg. of sodium hydroxide is added and the mixture is heated to reflux (100°-105° C.), maintaining it at this temperature for 2 hours. The polymer formed is dehydrated to a water content of less than 5%. Then 55 kgs. of furfuryl alcohol are added. The product is cooled to below 25° C., and 0.2 kg. of a silane having the general formula:

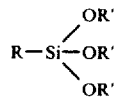

is added.

The characteristics of this resin are:

Viscosity at 25° C.: 1000/13000 cps

% in water <5

% in dry extract 50/55%

The catalyst was previously prepared in an autoclave provided with a stirrer, reflux condenser and cooling system, in which there are introduced 22 kgs. of water, then 57 kgs. of phenolsulfonic acid having a 65% concentration in water and a free sulphonic acid content of less than 5% are added under cooling. 11 Kgs. of polyvinyl alcohol of the V-03/140 type (E.R.T.) or type 4/98 (Hoechts) are added, and the mixture is stirred while heating to about 50° C. until the polyvinyl alcohol is completely dissolved. Then 10 kgs. of isobutylamine are added slowly while cooling to prevent the amine from evaporating. This catalyst can be packed and stored at a temperature lower than 25° C.

The mixture of resin and catalyst was completely homogenized for a period of 2 minutes.

The results, after application of a vacuum and polymerization within a mold, are illustrated in FIGS. 1 and 2.

EXAMPLE 2

400 gr. of siliceous sand having identical characteristics as in Example 1 were introduced in a mixer similar to that used in Example 1. Then 40 gr. of ferric oxide were added.

The mixture was homogenized, and then 35 gr. of the same catalyst as employed in Example 1, and 70 gr. of the same resin as employed in Example 1, were added to the mixture. The resultant mixture was mixed for a period of 2 minutes 30 seconds.

Figure 3:
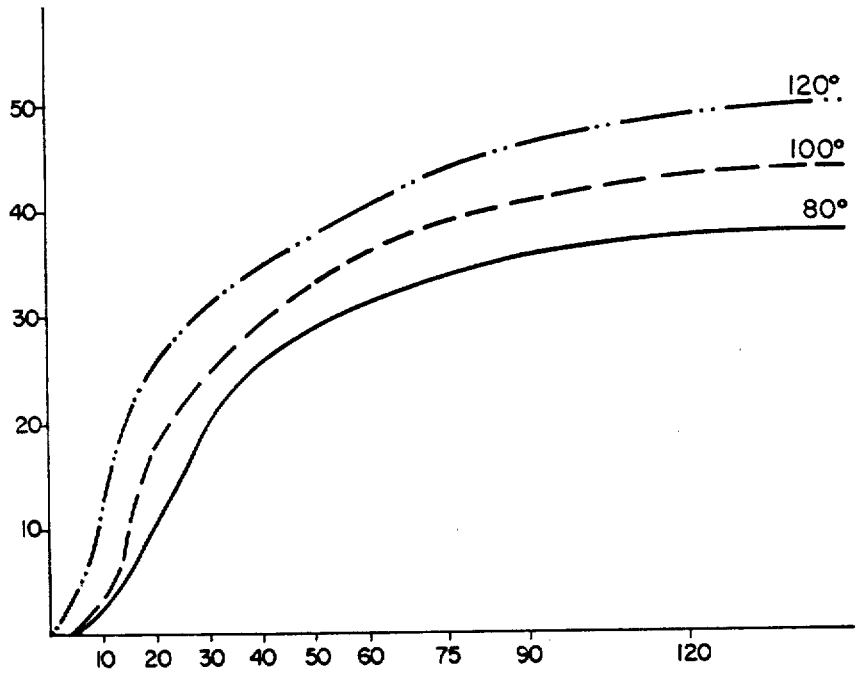

The results, after application of a vacuum and polymerization within a mold, are illustrated in FIGS. 3 and 4.

EXAMPLE 3

400 gr. of siliceous sand obtained in the local market with 55/60 AFA and a percentage of fines (<0.125 lower than 3%) were added to the same mixer used in the preceding examples.

Then 20 gr. graphite were added and the mixture was completely homogenized.

35 gr. of the same neutralized catalyst as in the preceding Examples as well as 70 gr. of the same resin were added thereto.

Figure 5:
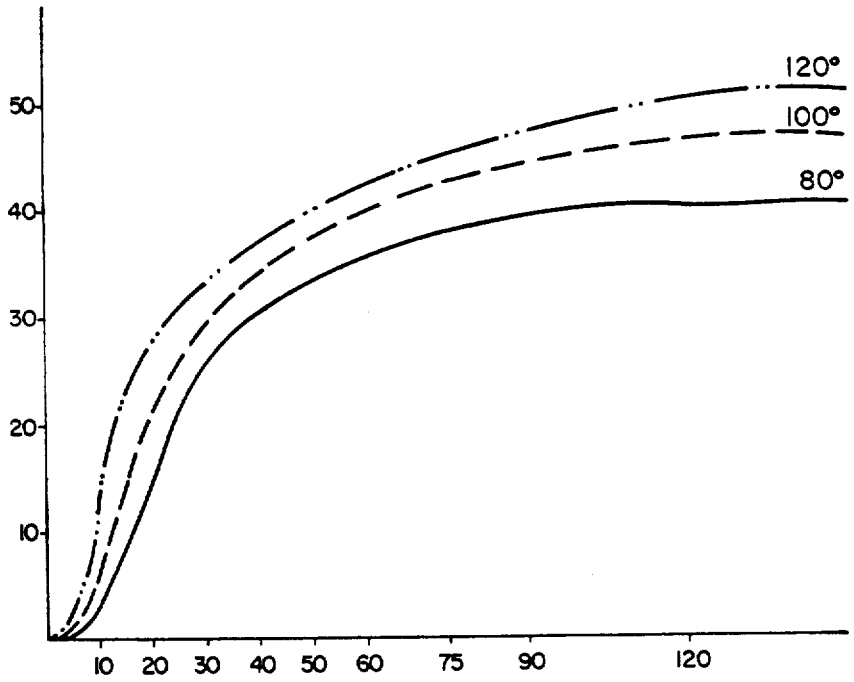

The total mixing time was of 2 minutes 30 seconds. The results, after application of a vacuum and polymerization within a mold, are illustrated in FIGS. 5 and 6.

I claim:

1. A process of binding aggregates, which comprises:

mixing the aggregates with a resin binder for said aggregates and a vacuum-activated catalyst for curing said binder, said catalyst being an acid neutralized with a base, which base is capable of being eliminated under application of a vacuum to a maximum residual pressure of 300 mm of mercury;

applying a vacuum, to a maximum residual pressure of 300 mm of mercury, to the mixture comprising said aggregates, binder and catalyst, to eliminate said base and thus activate said catalyst; and curing said binder at a temperature of 50° to 100° C.

2. A process according to claim 1, wherein said vacuum is applied to a maximum residual pressure of 10 to 70 mm of mercury.

3. A process according to claim 1, wherein said binder is a phenolic resin modified with furfuryl alcohol and having a water content lower than 5% by weight.

4. A process according to claim 3, wherein said phenolic resin is a reaction product between formol and phenol in a molar ratio of from 0.7/1 to 1.5/1.

5. A process according to claim 4, wherein the molar ratio of said phenol to said furfuryl alcohol is from 1/0.8 to 1/1.

* * * * *